US006382537B1

(12) United States Patent
Birke

(10) Patent No.: US 6,382,537 B1
(45) Date of Patent: May 7, 2002

(54) METHOD FOR REDUCTIVE DEHALOGENATION OF HALOGEN-ORGANIC SUBSTANCES

(76) Inventor: Volker Birke, Georgstrasse 14, D-31515 Wunstorf (DE)

( * ) Notice: Subject to any disclaimer, the term of this patent is extended or adjusted under 35 U.S.C. 154(b) by 0 days.

(21) Appl. No.: 09/508,515

(22) PCT Filed: Sep. 19, 1998

(86) PCT No.: PCT/DE98/02787

§ 371 Date: Mar. 24, 2000

§ 102(e) Date: Mar. 24, 2000

(87) PCT Pub. No.: WO99/15239

PCT Pub. Date: Apr. 1, 1999

(30) Foreign Application Priority Data

Sep. 25, 1997 (DE) ..... 197 42 297

(51) Int. Cl.[7] ..... B02C 19/12

(52) U.S. Cl. ..... 241/16; 241/21; 241/22

(58) Field of Search ..... 241/21, 30, 16, 241/22; 588/200, 205; 208/262.5, 262.1; 423/DIG. 15

(56) References Cited

U.S. PATENT DOCUMENTS

| | | | |
|---|---|---|---|
| 4,377,471 | A | 3/1983 | Brown et al. |
| 4,853,040 | A | 8/1989 | Mazur et al. |
| 4,950,833 | A | 8/1990 | Hawari et al. |
| 4,973,783 | A | 11/1990 | Griller et al. |

FOREIGN PATENT DOCUMENTS

| | | |
|---|---|---|
| AU | 6474 | 12/1992 |
| AU | 9085 | 5/1993 |
| CH | 668 709 | 1/1989 |
| DE | 34 10 239 | 10/1985 |
| EP | 0 225 849 | 6/1987 |
| EP | 0 288 408 | 10/1988 |
| EP | 0 456 457 | 11/1991 |
| EP | 0 467 053 | 1/1992 |
| EP | 0 491 452 | 6/1992 |
| WO | WO 94 14503 | 7/1994 |
| WO | WO 94/14504 | 7/1994 |
| WO | WO 95 18652 | 7/1995 |

OTHER PUBLICATIONS

Chemical Abstracts, vol. 126, No. 1, (1997) Steven, et al., "Selective Mechanochemical Dehalogenation of Chlorobenzenes over Calcium Hydride" XP 002091198 see abstract & Environ. Sci. Technol (1997), 31(1) 261–265 CODEN: ESTHAG; ISSN: 0013–936X, 1997.

S. A. Rowlands et al., "Destruction Of Toxic Materials", *Nature*, vol. 367 1994, p. 223.

J. March, *Advanced Organic Chemistry*, pp. 240 and 405.

K. Vollhardt, *Organic Chemistry*, 1987, Index and p. 955.

N. Isaacs, *Reactive Intermediates in Organic Chemistry*, 1974 p. 271.

V. Birke, "Zur reduktiven Dehalogenierung aromatischer Halogenverbindungen", (Doctoral Thesis), 1996.

G. Hirschfeld, Hausarbeit zum Ersten Staatsexamen, Jul. 1991.

F. Boelsing, "DCR–Technologie in der Altlastensanierung", *Berichte aus Wasserguete– und Abfallwirtschaft*, 1997, pp. 101–119.

(List continued on next page.)

*Primary Examiner*—Mark Rosenbaum
(74) *Attorney, Agent, or Firm*—Foley & Lardner

(57) ABSTRACT

The invention relates to a method for reductive dehalogenation of halogen-organic substances which can be used in solid or liquid mixtures of substances. When the parameters of the inventive method are correspondingly adapted, liquids and halogen-organic contaminated soils can be mechanically treated and consequently reductively dehalogenated by applying mechanical energy and adding elementary alkali metal, earth-alkaline metal, aluminum or iron as a reducing agent and at least one reactant with slightly activated hydrogen as a hydrogen source.

13 Claims, 6 Drawing Sheets

OTHER PUBLICATIONS

Two slide entitled "DCR Dehalogenations Techniques" (no date).

Letter from Professor Faulstich to Dr. Boelsing, Dec. 5, 1996.

Conference schedule listing Dr. Boesling under the topics "Irreversible Immobilisierung von Schwermetallen in kontaminierten Standorten" and "Immobilisierung und Detoxifizierung organischer Schadstoffe", Jan. 29, 1993 (F).

Conference schedule listing Dr. Boelsing under the topic "Sanierung durch Immobilisierung und Detoxifizierung organischer und anorgansicher Schadstoffe", May 26, 1993.

Conference schedule listing Dr. Boelsing as a speaker, conference entitled "Altdeponien/Altlasten", 6/23–24/1993 (W–T).

Dr. Boelsing, "Versuchsansaetze zur tribochemischen Dehalogenierung von Halogenaromaten", Feb. 1, 1995.

Copy of fax from Mr. Eikum to Dr. Boelsing, Mar. 5, 1995.

Copy of letter to Dr. Eikum, May 17, 1995.

Copy of letter to Dr. Eikum, May 29, 1995.

Copy of letter to Dr. Eikum, Aug. 2, 1995.

Copy of letter to Mr. Berg, Aug. 7, 1995.

Dr. J. Berg et al., "Treatment of PCB and DDT in Soil by Chemical Detoxification", *Summary Report of the Research Council of Norway* (no date).

Copy of telefax from Volker Birke to Dr. Boelsing, Apr. 24, 1996.

Copy of letter from Dr. Payne to Dr. Boelsing, Jul. 19, 1992.

Copy of letter from Dr. Boelsing to Dr. Payne, Aug. 13, 1992.

Copy of a letter from Dr. Boelsing to the University Library of the University of Hanover, Dec. 15, 1996.

Copy of a letter from the University Library of the University of Hanover, Mar. 3, 2001.

Copy of excerpt from *Praxis der Naturwissenschaften Chemie*, Heft 6/42 (no date).

*Roempp's Chemie Lexikon* definition of "Mechanochemi" (Mechanochemical), (1992).

*Roempp's Chemie Lexikon* definition of "Ultraschallchemi" (Ultrasonic Chemistry), (1992).

Copy of "Mechanochemical Reaction of DDT with Calcium Oxide", (no date).

Copy of letter of DCR International Environmental Services, Oct. 19, 1992.

Copy of Minutes of Meeting, Apr. 9, 1996.

Copy of letter from Mr. Berg to Prof. Boelsing dated Apr. 11, 1998.

METHOD FOR REDUCTIVE DEHALOGENATION OF HALOGEN-ORGANIC SUBSTANCES

BACKGROUND OF THE INVENTION

1. Field of the Invention

The present invention is related to a process of reductively dehalogenating halo-organic substances in solid or liquid form. During this process the substance or mixture of substances is treated by adding elementary alkali metal, alkaline earths, aluminium or iron as the reducing agent and at least one reagent with relatively easily activated hydrogen to provide the source of hydrogen. This process is especially suitable not only for the detoxification of halo-organically contaminated solids and other materials with complex compounds, but also the decontamination and if required the recycling of liquid or predominantly liquid substances which have been halo-organically contaminated.

2. Description of Related Art

Until now it has not been possible to detoxify toxic polyhalogenated organic contaminants with any of the cleaning techniques or technology currently available in ways which have been either economically or ecologically advantageous or had future potential. These substances are frequently present as contaminants, and what is more in large quantities, in the ground, in sediment on riverbeds or on the seabed, in sludge, in the dust particles collected in filters, in building materials, in oil which has seeped out, in used oil, etc which means that they have come in contact with and are found in the company of an indeterminate number of foreign substances with a great range of different characteristics. The decontamination and cleaning up of such a complex combination of heterogeneous, solid, solid-liquid or liquid materials and old dump sites poses particularly difficult problems.

It is true that there are a number of thermal processes and other very energy-intensive processes for destroying dangerous hydrocarbons of the sort named above and also for those which in particular are dispersed throughout materials of a complex composition. Included here, among others, are incineration at a high temperature and incineration in baths of molten glass or in salt baths. However, each of these processes presents some specific disadvantages so that there is a need to develop alternative technologies.

For example, incineration at a high temperature is not only extremely cost-intensive, but also creates new problems. In polychlorinated compounds it can cause PCDD (dioxins)/PCDF (dibenzofuranes) to be formed which must be removed afterwards using several involved processes from the flue gas and from the dust particles collected in the filters, then disposed of. The currently used method of "disposal" of these highly toxic dust particles frequently consists of dumping them in so-called hazardous waste dumps.

Of the biological methods of breaking down toxic organic compounds in complex matrices, each also presents its own specific disadvantages which restrict the ability to make general use of them.

Processes based on the use of alkali metals have found a certain acceptance. In these processes, pulverised metal suspensions or metal dispersions are used in indifferent liquid mediums, like for example white oil; however, the range of their applications is mainly restricted to a few specific problems, ie. the detoxification of relatively pure liquid contaminants or mixtures of contaminants or practically homogeneous, contaminated liquids which do not contain water, such as, for example, transformer oil or used motor oil containing PCBs.

Further processes, in which other non-noble metals alone are used with a low power of reduction, like for example aluminium, zinc or iron, are not suitable for the detoxification of certain groups of important materials, for example polychlorinated aromatics, because the latter cannot be fully dechlorinated with these metals. Not all chlorine atoms of a polychlorinated molecule are removed in this way and detoxification is not achieved, or only in the presence of toxic catalysts or promoters, for example, triphenylphosphine, nickel or nickel compounds which for toxicological reasons also cause serious problems. The use of toxic substances for the dehalogenation of halo-organic substances in soil, sediment, etc only means exchanging the existing type of contamination for another one and thus does not offer a solution to the problem.

The known processes which are used for liquids or mixtures of liquids cannot easily be transferred to solids. It is frequently difficult for reagents to reach halo-organic substances which are contained in solids due to the high level of resistance to transport in reactions between solids. Polyhalogenated organic substances are present in the environment as contaminants, for example, in the soil, in the sediment on riverbeds or on the seabed, in sludge, in the dust particles collected in filters, in building materials or in oil which has seeped out, thus without exception in very heterogeneous solid or solid-liquid materials. These polyhalogenated organic substances can be found in large quantities and due to the complex forms and conditions that these matrices can be present in and as a result the various ways they can be resistant to transport they are particularly difficult to get at and thus they can only be made to react partially or not at all.

Thus, the problem which is the basis of this invention consists of creating a process for reductively dehalogenating halo-organic substances in such a way that it is possible to dehalogenate, using a universally applicable process, various heterogeneous solid and liquid mixtures of substances, in particular also mixtures of a complex composition and contaminated areas of ground in which not all of the substances present are known. This process should neutralise as many of the contaminants as possible and not give rise to any new harmful by-products.

In addition, the process should be as simple as possible to carry out and take effect relatively quickly.

SUMMARY OF THE INVENTION

To solve this problem according to the invention, the idea is to use a process as described at the beginning and then subject the halo-organic material or the mixture of substances to milling or grinding with mechanical activation with all substances present being treated together in one step and being reductively dehalogenated more or less completely.

The invention can be applied to halo-organic compounds which are contained in foreign substances or mixtures of foreign substances in solid or liquid form, and also to solid or liquid halo-organic substances, whether present in their pure form or mixed in with other halo-organic substances. When using the basic process, these substances or mixtures of substances are treated in one single step only, in which all the components are mixed together intensively, along with at least one reducing agent and one source of hydrogen, with the reaction taking place in mild operating conditions.

DETAILED DESCRIPTION OF PREFERRED EMBODIMENTS

Figure 1A:
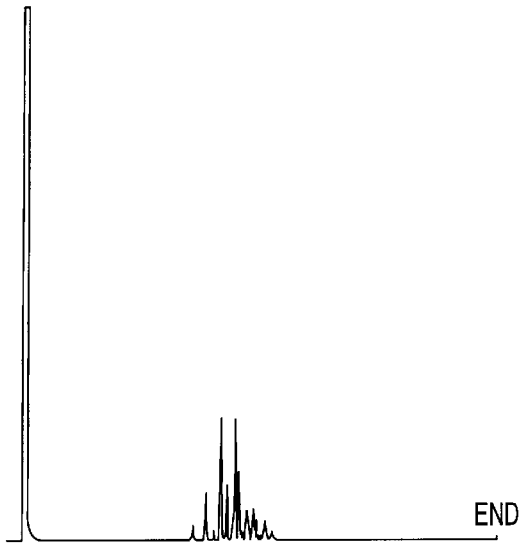
FIGS. 1*a* and 1*b*, 1*c*, 1*d* depict gas chromatographic spectra of a sample before and after treatment according to the invention.
Figure 1B:
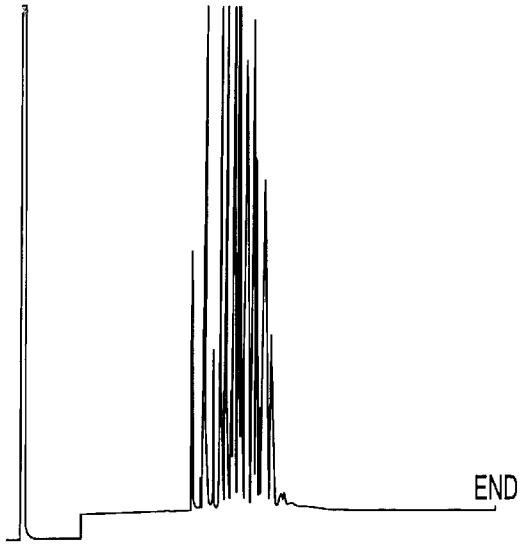
Figure 1C:
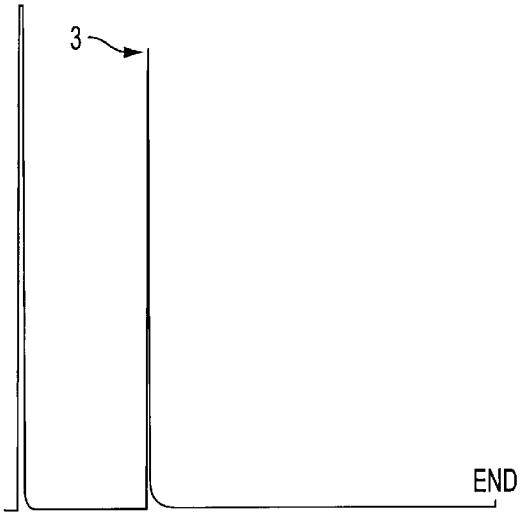
Figure 1D:
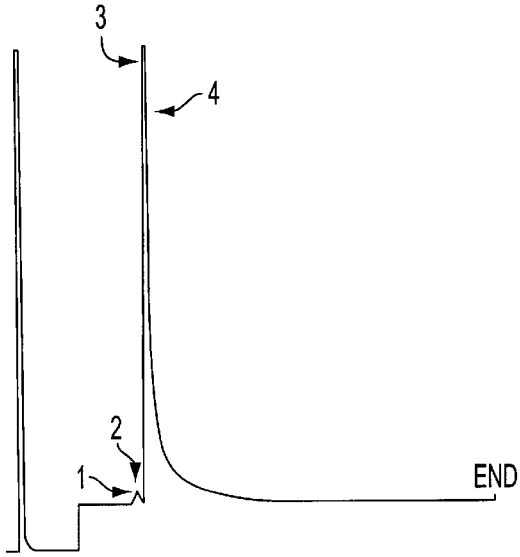
Figure 2B:
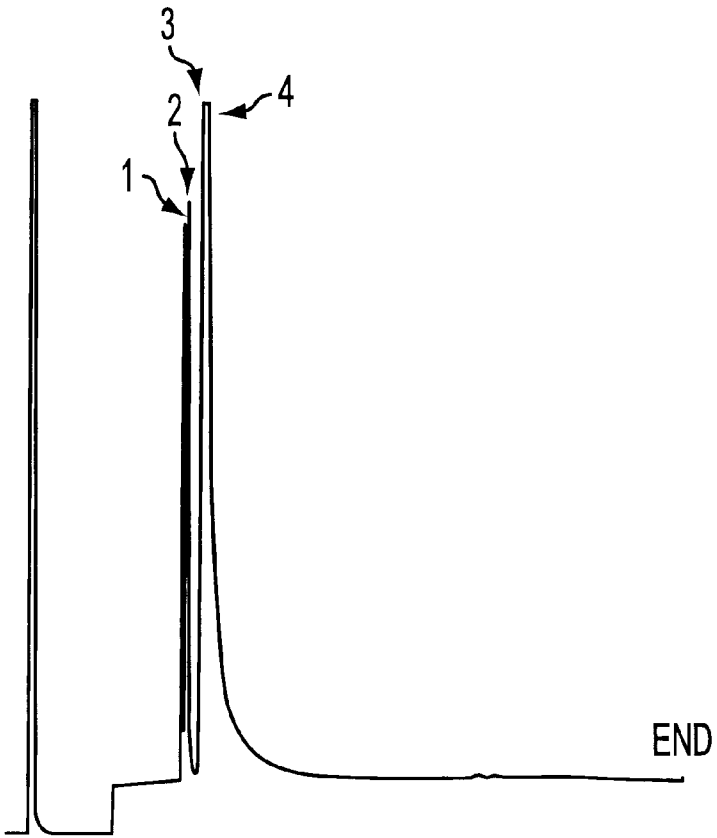
FIG. 2 depicts a gas chromatographic spectrum of a sample.
Figure 2A:
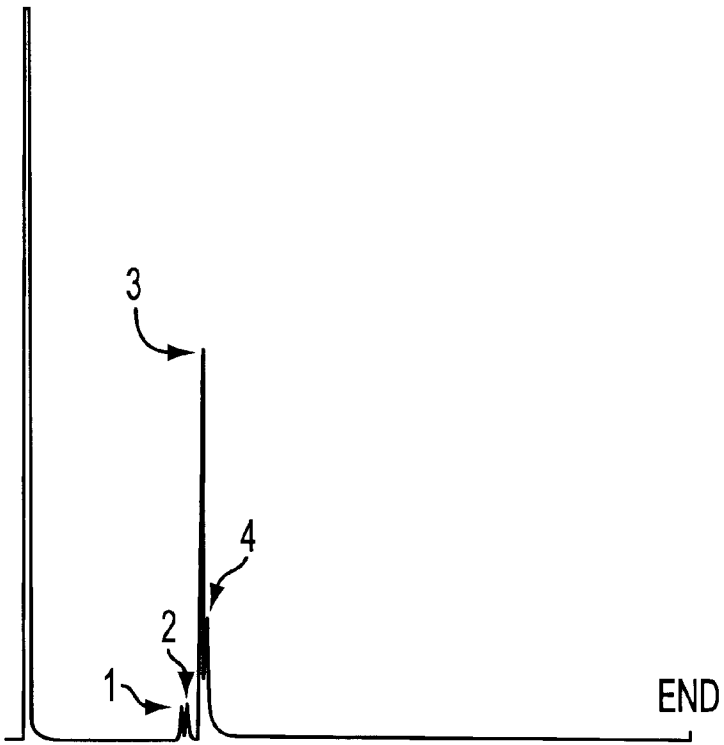

The process of the invention involves grinding down the components involved in the reaction with a greater or smaller amount of mechanical energy. This has the effect of at least pulverising the components of the mixture into very small particles, thus bringing about a very intensive mixing together of all the components, so that over an average amount of time a very intensive contact is established between the reagents which have been used and the halo-organic substances, and the latter can thus be caused to react in the desired way. In addition, the reactive capacity of the solid components is increased during the process of being pulverised due to the physical effects on their surfaces.

What is more, with the application of a sufficient amount of energy, the reactive capacity can be greatly increased. This mechanically activated treatment for solids or solid-liquids seems to be particularly suitable for breaking down completely or almost completely polyhalogenated compounds with the help of hydrogen donors.

Due to the increase in reactive capacity of the solids as a consequence of the special mechanical activation, even substances which are spread throughout complex solid or solid-liquid materials, can be got at chemically and efficiently converted. Consequently, organic contaminants which are present in solid matrices like the ground, sediment, etc, can also be specifically targeted and destroyed by employing reactions which break them down supported by mechanical activation.

In comparison to incineration at a high temperature and other energy-intensive processes, the process as described in this invention has the advantage that when it is being carried out the reaction only requires mild operating conditions to be provided, ie. generally it can be done at room temperature and under normal pressure, and that it is technically far less complicated. It can therefore also be set up as a mobile unit. A further advantage consists in the fact that, if necessary, it is possible to recycle or make further use of the material which is to be decontaminated, thus avoiding destroying it which would inevitably happen if it were incinerated.

In principle, the process works at low temperatures, preferably at room temperature under normal pressure. However, it is also possible that an increase in temperature will occur due to the intensive application of mechanical energy and/or due to the heat given off by the reaction which occurs during the course of the process of dehalogenation.

It is advantageous to use at least a slightly excessive amount of the metallic reducing agent. The required amount of reducing agent can be determined during experimental pre-tests on the matter which is to be decontaminated itself.

In general, the idea is to use non-noble metals as reducing agents, and in particular, alkali metals, alkaline earths, aluminium and iron. Among the alkali metals, sodium and potassium are preferable and among the alkaline earths magnesium and calcium. When using the principles of this invention, however, other non-noble metals can also be employed, but care must be taken that the formation of toxic products is avoided.

The reductive removal of halogens from halo-organic substances with the help of non-noble metals, in particular alkali metals, has in principle been known for a long time and has been well tested mechanistically. Until now, however, it has only been acknowledged by a few people that some of these reactions can also be used to eliminate toxic organic materials in our environment. According to this invention, the reduction with metal is also supported by the application of mechanical energy and the addition of at least one hydrogen donor.

What is surprising is that polychlorinated aromatics in liquid, solid or solid-liquid materials can also be completely dechlorinated reductively with magnesium in a one-pot reaction at room temperature. Among other things, magnesium shavings of the sort which have been used on a large scale for decades in laboratories and in industry for the production of Grignard reagents were employed. There is a widely-held view that Grignard reactions can practically only be carried out in special highly purified, highly flammable solutions which are toxicologically of concern, like for example diethylether or tetrahydrofurane, with, in addition, all moisture being strictly excluded, and inert gas and special catalysts needing to be used. In contrast to this, it was seen for example, that in a pure liquid state only by dissolving the metal in methanol and in a solid matrix by using ball milling and adding a little methanol, ethanol or low molecular primary amines, Grignard and Zerewitinoff reactions which were linked to each other were successfully carried out in a solid sand matrix.

As a source of hydrogen with at least lightly activated hydrogen, it is preferable to use alcohols, ethers, polyethers, amines or hydroxides, like for example, calcium hydroxide, metal hydrides or non-metal hydrides, like for example, calcium hydride, sodium hydride, sodium boronate, lithium alanate, trialkylsilane, polyalkylhydrogensiloxane individually or in combination.

From the group of alcohols, for example, low molecular aliphatic alcohols can be used. By low molecular alcohols, aliphatic alcohols, for example, with 1 to 7 carbon atoms are meant, like methanol, ethanol, propanol, isopropanol, butanol, secondary and tertiary butanol, pentanol, hexanol, heptanol, cyclopropanol, cyclobutanol, cyclopentanol, cyclohexanol, cycloheptanol, 2-methylcyclopropanol, cyclopropylmethanol, polyalkylenglycols, simply etherised polyalkylenglycols, aminoalcohols, polyols, like for example ethylene glycol, glycerine, pentaerythritol and others.

From the group of ethers, for example, simple symmetric or asymmetric aliphatic ethers, cyclic ethers or polyethers can be used. Examples include diethylether, propylether, isopropylether, n-butylether as well as dimeric or trimeric polyethers, coronands, cryptands, spherands, etheramines, like for example 2-methoxyethylamine, etc.

From the group of amines, it is preferable to use aliphatic amines and among these low primary or secondary aliphatic amines. Examples of suitable amines are: primary, secondary or tertiary aliphatic and alicyclic monoamines or polyamines, methylamine, ethylamine, 1- and 2-propylamine, 1- and 2-butylamine, ethylene diamine, tri-, tetra-, penta-, hexamethylene diamine, dimethylamine, diethylamine, di-n-propylamine, cyclopentyl- and cyclohexylamine, nitrogen heterocycles and perhydro nitrogen heterocycles, for example piperidine, 1-(2-aminoethyl)-piperazine, 1-(2-aminoethyl)-pyrrolidine and 1-(2-aminoethyl)-piperidine, 4-(2-aminoethyl)-morpholine. Furthermore, liquid ammonia is also suitable for the same purpose.

As an alternative to the amines, certain amides can also be considered. For example, the following can be used: 1,3 dimethyl-3,4,5,6-tetrahydro-2(1H)-pyrimidon (dimethylpropylene urea, DMPU), 1,3-dimethyl-2-imidazolidinon (N,N-dimethylethylene urea, DMEU), 1-methyl-2-pyrrolidon (NMP), 1-ethyl-2-pyrrolidon, N,N-diethylacetamide, N,N-diethylpropionamide, N,N-diethylisobutyramide.

The separate addition of a source of hydrogen can be omitted if it is known that a substance which is suitable as a source of hydrogen is already present in sufficient quantity in the mixture which is to be treated.

The mechanical processing as described in this invention can consist of milling in a mechanical mill, for example a ball mill, a hammer mill or a vibratory mill. During this milling, milling supplements can be employed in addition. In general, milling supplements are materials which can reduce the amount of energy on the surfaces and/or reduce the extent to which the shape of solids is deformed when mechanical energy is applied. Included here are for example: surface-active substances in various states, forms or preparations, like for example quaternary ammonium compounds which do not only have to be applied in their pure form, but can also be applied immobilised on inert surface-active carriers, like layers of silicate, clay (so-called "organophilic bentonites") as well as substituted alkylimidazolines and sulfosuccinamides, fatty acids, fatty acid esters and fatty acid amides, primary, secondary and tertiary alkylamines and fatty amines with one or several amine groups, alicyclic amines, like for example, cyclohexylamine, polyhydro nitrogen heterocycles, like for example, piperidine (hexahydropyridine) mono-, di-, or trialkanolamines, simple glycols, polyalkylene glycols, like for example, polyethylene glycol and polypropylene glycol, and their mono- or diethers, organosilicon compounds, particularly silicones, specific anorganic salts which are suited for this purpose, for example aluminium chloride.

The course of the reaction which has already been mechanically activated can be further intensified or sped up by the additional application of reaction accelerators. Substances which can be used as reaction accelerators are those which have the capacity to partially or completely dissolve non-noble metals, in particular alkali metals and earth alkalines and/or to promote their dissociation into metal cations and metal anions and/or to promote the formation of solvated electrons, and/or to solvate and/or to stabilise metal organic compounds, like for example, alkali metal or alkaline earth organic compounds, like for example, liquid ammonia, primary, secondary or tertiary aliphatic and alicyclic monoamines or polyamines, polyhydro nitrogen heterocycles, aliphatic and cyclic monoethers, podands, coronands, cryptands, spherands, etheramines, like for example 2-methoxyethylamine, amides, like for example, 1,3-dimethyl-3,4,5,6-tetrahydro-2(1H)-pyrimidon (dimethylpropylene urea, DMPU), 1,3-methyl-2-imidazolidinon (N,N-dimethylethylene urea, DMEU),1-methyl-2-pyrrolidon (NMP), 1-ethyl-2-pyrrolidon, N,N-diethylacetamide, N,N-diethylpropionamide, N,N-diethylisobutyramide.

The milling supplements and/or reaction accelerators can be added to the substance or mixture of substances in a later step, ie. separately after the reactants have been added, and they can they be mechanically worked into the mixture.

On the one hand, the metallic reducing agent can be directly added to the mixture in a pure form. In particular this would seem to be the thing to do with the alkaline earths, which are less reactive when exposed to air than the alkali metals, for example, magnesium shavings.

Alternatively, the metallic reducing agent can be present in a preparation, either finely dispersed or suspended, for example, finely dispersed in a non-oxidising liquid or in the liquid source of hydrogen. It is advantageous to use dispersions of the chosen metal in white oil, paraffin or in ethers, even polyethers like diglymes, triglymes, tetraglymes, polyethylene glycol and polyethylene glycol derivates, etherised diglymes and polyglymes.

Furthermore, the metallic reducing agent can be mixed in with or attached to a solid carrier. A favourable preparation has proven to be, for example, a mixture of alkali metal, particularly sodium, with calcium silicate or calcium oxide.

It was found that the use of ball milling alone was also suitable for increasing the reactivity of the metals in one isolated step of the process by mechanically pulverising them. It was particularly suitable for pulverising alkali metals on surface-active solid inert carrier substances. Compared to conventional processing methods, in which molten alkali metal is brought onto solid inert carrier substances by stirring it in at a high temperature in a special machine, the new method has the advantage that it operates at room temperature and that the procedure is simpler and quicker. This is because the alkali metal and the carrier material are simply put into a mill or a container for grinding and within a few minutes they are ground to a homogeneous dispersion consisting of fine powder.

If desired the process can thus be carried out in two steps, whereby, for example, in the first step pulverised metal is produced by using ball milling and is then ground down again in a second step with reaction accelerators or, as required, further supplementary substances being added. Furthermore it is also possible to grind in or mix in alkali metal dispersions which have been produced using conventional methods, ie. both dispersions in inert fluids and those on inert solid carriers, with reaction accelerators and if necessary further supplementary substances in a solid containing halo-organic substances and in this way bring about dehalogenation.

The process can also be used to supplement other processes, for example, washing processes, or be combined with such processes. Preparing contaminated ground in advance with calcium oxide (lime or quicklime) which is also known from other treatment processes and among other things serves to dry out the mixture, can make good sense in certain cases.

The process can be carried out discontinuously, in batches or continuously.

When using the discontinuous method, the first step is to put all the components involved in the reaction, ie. at least the substance to be treated or the mixture, the metallic reducing agent and the hydrogen donor into a machine which will treat them mechanically, like a mill or a (dynamic) mixer. When decontaminating in solid or solid-liquid mediums it is more usual to use a mill, for example, a ball mill, a hammer mill or a vibratory mill, whereas with liquid systems a mixer can be sufficient. As mixers, friction mixers, screw-type mixers or roller mixers, for example, are suitable.

One advantage of this invention is that the processing can be completed in just one step in which the components of the reaction can be added one after another or gradually. The continuous method could, for example, be carried out in a screw-type mill or in a screw-type mixer.

In the following section, the process will be explained in more detail with the help of some examples.

EXAMPLE 1

Test Ground Contaminated with Chlophen/Na—Ca-silicate/n-butyl Amine

Using an eccentric vibratory mill, model number "ESM 234", from the Siebtechnik company in the town of M ühlheim an der Ruhr, which is 80% full with steel balls (each 20 mm in diameter), 3.8 kg of quartz sand (bulk weight 1.27 g/ml) is mixed in with 180 g of calcium oxide for the purpose of drying and ground up for ten minutes. 10.2 g of n-butylamine is also added and ground in for one minute. Finally 156.7 g of a 26% sodium calcium silicate dispersion is added and ground up for 30 minutes with the contaminated test ground.

The test ground was artificially contaminated by adding a mixture of 5 g of chlophen A30 and 150 g of calcium oxide/calcium hydroxide which was ground in for 5 minutes.

The GC-ECD analysis (internal standard: decachlorbiphenyl) of a sample of the test ground after this treatment showed a 99.7% reduction of the PCBs. Furthermore, based on the GC results, the presence or formation of other halo-organic substances can be ruled out.

Production of the 25% Sodium Calcium Silicate Dispersion

A centrifugal ball mill S1, from the Retsch company in the town of Haan, which has a 500 ml stainless steel grinding container with 3 stainless steel balls (each 20 mm in diameter) and a stainless steel lid with a rubber sealing ring was used. Into this is placed 150 g of surface-active calcium silicate (for example, from the company "Cape-Boards Siborit" GmbH in the town of Lüneburg, or xonolit, from the company "Eternit" SA in the town of Kapelle OP den Bor in Belgium) mixed with 50 g of sodium pieces and an atmosphere of argon and this is ground up for 5 to 15 minutes at maximum revolutions (approximately 500 $min^{-1}$). The result is a dark grey homogeneous highly reactive powder. Other especially favourable carrier substances have proven to be waterless clays, for example tixogel or tixosorb from the Süidchemie company in the town of Moosburg.

EXAMPLE 2

Test Ground Contaminated with Chlophen/Mg/tetraglymes/n-butyl Amine

In an eccentric vibratory mill "ESM 234" (for the details see example 1), 3.8 kg of quartz sand (bulk weight 1.27 g/ml) is mixed with 200 g of calcium oxide for the purpose of drying and ground up for 10 minutes. Then, also by grinding in for a period of two minutes, a mixture of 5 g of chlophen A30 and 150 g of calcium oxide/calcium hydroxide, 18.2 g of n-butylamine and 51.1 g of tetraethylene glycol dimethylether (tetraglymes) is added. Finally 102 g of magnesium shavings are ground in for two hours.

The GC-ECD analysis (internal standard: decachlorbiphenyl) shows a 99.7% reduction of the PCBs. The presence or formation of other halo-organic substances can be ruled out.

EXAMPLE 3

Pre-treated Ground Contaminated with PCBs/Na/n-propylamine

The object to be treated is a section of cohesive ground which has been contaminated with PCBs and has been put through a washing process with water and surfactant before the treatment. From the suspended fraction of this process which was precipitated with the help of flocculants based on polyamides, there was some residual PCB contamination of approximately 250 ppm which could not be removed. In an eccentric vibratory mill "ESM 234" (for details see example 1), 3 kg of this ground fraction which has been contaminated with PCBs and which, after being thermally pre-dried, has a residual level of moisture of approximately 2%, is mixed with 200 g of calcium oxide for the purpose of drying and ground up for 30 minutes. 150 g of n-propylamine is also mixed in by milling for one minute and then is left to stand for 5 minutes. Finally 200 g of sodium in the form of cylindrical pieces (each 1 to 2 cm long and fat) is ground in for 45 minutes.

The GC-ECD analysis (internal standard: decachlorbiphenyl) shows a 98.5% reduction of the PCBs. The presence or formation of other halo-organic substances can be ruled out.

As high amounts of polyamides were mixed in, a greater amount of sodium had to be added than would have been required for the complete dechlorination of the PCBs alone.

EXAMPLE 4

Pre-treated Ground Contaminated with PCBs/Na/tetraglymes 3 kg of the ground fraction which has been contaminated with PCBs as used in example 3 is put through a washing process then thermally pre-dried until it has a residual level of moisture of approximately 2%. It is placed in an eccentric vibratory mill "ESM 234" (for details see example 1) and mixed with 200 g of calcium oxide for the purpose of drying, then ground up for 30 minutes. 100 g of tetraglymes are mixed in, also by grinding in, for a minute. Finally, 200 g of sodium (cylindrical pieces, 1 to 2 cm long and thick) are ground in for 90 minutes and then the contents of the mill are left to stand overnight without taking any further measures.

The GC-ECD analysis (internal standard: decachlorbiphenyl) shows that the PCBs have been broken down by 92% after 90 minutes and after being left to stand overnight they have been broken down by more than 99.9%. The presence or formation of other halo-organic substances can be ruled out.

EXAMPLE 5

Sea Sand Contaminated with Chlophen/Na—CaO/ECOH-triglymes

Into a centrifugal ball mill S1, from the Retsch company in the town of Haan, with a 50 ml stainless steel grinding container with 3 stainless steel balls (each 10 mm in diameter) and a stainless steel lid with a rubber sealing ring are placed: 0.05 g of chlophen A30, 10 g of sea sand (analytical grade), 0.25 g of triglymes and 0.52 g of ethanol (=19.1 equivalents per total chlorine) and they are ground down for one minute at maximum revolutions (approximately 500 $min^{-1}$). After one minute of milling, the grinding container is removed from the mill, opened and rinsed with argon under an up-turned funnel (5.0, from the Linde company). Then a sodium-calcium oxide dispersion (52% Na) is quickly added in an argon shower, the addition of argon gas is continued for a short time and finally the lid of the grinding container is put back on again. Milling is then carried out for one hour at maximum revolutions.

The GC-MS analysis shows that the PCBs have been completely broken down (the main product left over after this process was phenylcyclohexane). The presence or formation of other halo-organic substances can be ruled out.

The Production of a 52% Sodium-calcium Oxide Dispersion

One possible way of distributing sodium on calcium oxide in a dry way is to grind up small pieces of sodium with calcium oxide in a centrifugal ball mill for 5 to 15 minutes, as described for the surface-active materials (see above). In this way 5% of the alkali metal can be homogeneously distributed on the carrier. To get useful sodium calcium oxide dispersions you first of all let the alkali metal work on calcium oxide in the presence of toluol under conditions which allow reflux and then mix up the result of this process at high speed in a high speed stirrer or dispersion machine, for example ultra-turrax from the company "Janke & Kunkel". After distilling off the toluol a dark grey solid made up of fine powder which when looked at appears completely homogeneous is left. Using this method, different continuously variable concentrations of the alkali metal can be created in the dispersion. Apart from the sodium calcium oxide system, the method can be applied very flexibly: for example, it is also possible to use it to prepare a 25% potassium calcium oxide dispersion which outwardly resembles the sodium dispersion. A dark grey completely homogeneous powder is the result. However, it is pyrophoric when exposed to air and therefore cannot easily be used for the dechlorination of polychloraromatics in solid or solid-liquid matrices. For organic and chemical conversions on a laboratory scale with suitable inert gas and safety techniques, however, the possibilities for applying such a potassium calcium oxide dispersion would be interesting.

EXAMPLE 6

Chlophen, Contaminated Sea Sand (Test Sample)/Mg/MeOH 15 g of sea sand (analytical grade), 0.5 g of a calcium oxide/calcium hydroxide mixture which has been produced by partially dissolving 56 g of CaO with 14 g of $H_2O$, 0.5 g of triglymes, 0.11 g of chlophen A30, 0.3544 g of methanol and 0.51 g of magnesium powder are placed in a centrifugal ball mill S 1 (see example 5) and ground up for 5 hours at maximum revolutions after the mixture had been covered with an atmosphere of argon in the open grinding container.

The GC-MS analysis showed that the PCBs had been completely broken down (the main product left over after this process was biphenyl, along with a little phenylcyclohexane). The presence or formation of other halo-organic substances can be ruled out.

EXAMPLE 7

Sea Sand Contaminated with Chlophen (Test Sample)/Mg/n-propylamine 15 g of sea sand (analytical grade), 1 g of a calcium oxide/calcium hydroxide mixture, 0.25 ml of n-propylamine, 0.1 g of chlophen A30 and 0.76 g of magnesium shavings were put into a centrifugal ball mill S 1 (see example 5) and ground up for one hour at maximum revolutions.

The GC analysis showed that the PCBs had been completely broken down (the main product left over after this process was biphenyl, along with 1-phenylcyclohexene, a little phenylcyclohexane). The presence or formation of other halo-organic substances can be ruled out.

EXAMPLE 8

The Dehalogenation of Polychloraromatics in Solution by Adding Small Amounts of Low Chain Aliphatic Amines Surprisingly, it was found that polychloraromatics like 1,3,5-TCB could be dechlorinated much better with sodium in the presence of even small portions of n-butylamine than with other systems which had been tested.

TABLE 1

The dechlorination of 1,3,5-trichlorobenzene in dodecylbenzol (3 ml of each)[a] using in each case approximately 2 equivalents[a] of sodium[b] and adding various polyethers (5 ml of each) at room temperature after 2 hours.

| Na equivalent | 1.99 | 2.05 | 2.11 | 2.02 | 2.05 |
|---|---|---|---|---|---|
| additives | — | diglymes | triglymes | PEGDM 500[d] | TEGM[e] |
| $n_{rel}(Cl^-)$[c] [mol %] | 3.7 | 59.0 | 58.9 | 69.6 | 44.1 |

[a]equivalents or total organic chlorine
[b]Na in the form of a 45% Na hard paraffin dispersion
[c]The relationship in percentages of released chloride (determined by mercurimetry) to total organic chlorine
[d]Polyethylene glycol dimethylether mixture with an average molar mass of 500[e] of triethylene glycol monomethylether.

TABLE 2

The dechlorination of 1,3,5-trichlorobenzene in dodecylbenzol (3 ml of each) with in each case approximately 2 equivalents[a] of sodium[b] in the presence of various aliphatic amines under variable conditions after 2 hours at room temperature.

| Na-equivalent | 2.03 | 2.07 | 1.97 |
|---|---|---|---|
| amine | $Et_3N$ | $Et_2NH$ | n-$BuNH_2$ |
| amount of amine[ml]/equivalent[a] | 2/3.5 | 2/4.6 | 1/2.4 |
| $n_{rel}(CL^-)$[mol %] | 2.3 | 31.4 | 94.2 |

[a]Equivalents or total organic chlorine
[b]Na in the form of a 45% Na hard paraffin dispersion

TABLE 3

The dechlorination of 1,3,5-trichlorobenzene in dodecylbenzol (3 ml of each) with in each case approximately 2 equivalents of sodium in n-butylamine/diglyme mixtures, the reduction of the amine content after 2 hours at room temperature.

| Na equivalent | 2.04 | 2.04 | 2.01 | 2.02 |
|---|---|---|---|---|
| n-$BuNH_2$[ml]/equivalent | 2/4.88 | 0.4/0.98 | 0.2/0.49 | 0.05/0.12 |
| diglymes[ml] | 0.5 | 4 | 4 | 4 |
| $n_{rel}(Cl^-)$[mol %] | 95.5 | 91.7 | 91.3 | 91.4 |

The mechanical processing can be done by stirring in a reactor or in a suitable mixer.

EXAMPLE 9

Sea Sand Contaminated by Clophen (Test Sample)/Mg/DMPU 7.5 g of sea sand (analytical grade) and 2.0 g of magnesium shavings mixed with argon are ground up for five minutes in a centrifugal ball mill S 1 (see example 5). Then 0.1 g of chlophen A30, 7.5 g of sea sand (analytical grade) and 0.5 g of 1,3-dimethyl-3,4,5,6-tetrahydro-2(1H)-pyrimidon (dimethylpropylene urea, DMPU) are added, rinsed with argon and ground up at maximum revolutions for 30 minutes. The GC analysis showed that the PCBs had been completely broken down (the main product left over after this process was biphenyl). The experiment can also be carried out with other special amides instead of DMPU, like for example 1,3-dimethyl-2-imidazolidinon (N-N-dimethylethylene urea, DMEU) or 1-methyl-2-pyrrolidon (NMP), with a very similar development and with the same result.

EXAMPLE 10

Dehalogenation in Pure Liquids 7.0 g of decane in which 0.8 g of chlophen A30 has been dissolved and which still contains 2 g of n-propylamine is ground up with 9.4 g of magnesium shavings for 30 minutes at maximum revolutions in a centrifugal ball mill S 1 (see example 6).

Afterwards the GC-FID analysis showed that the PCBs had been almost completely broken down (the main product left over after this process was biphenyl, along with only insignificant amounts of 3 mono- or dichlorbiphenyls).

Figure 3A:
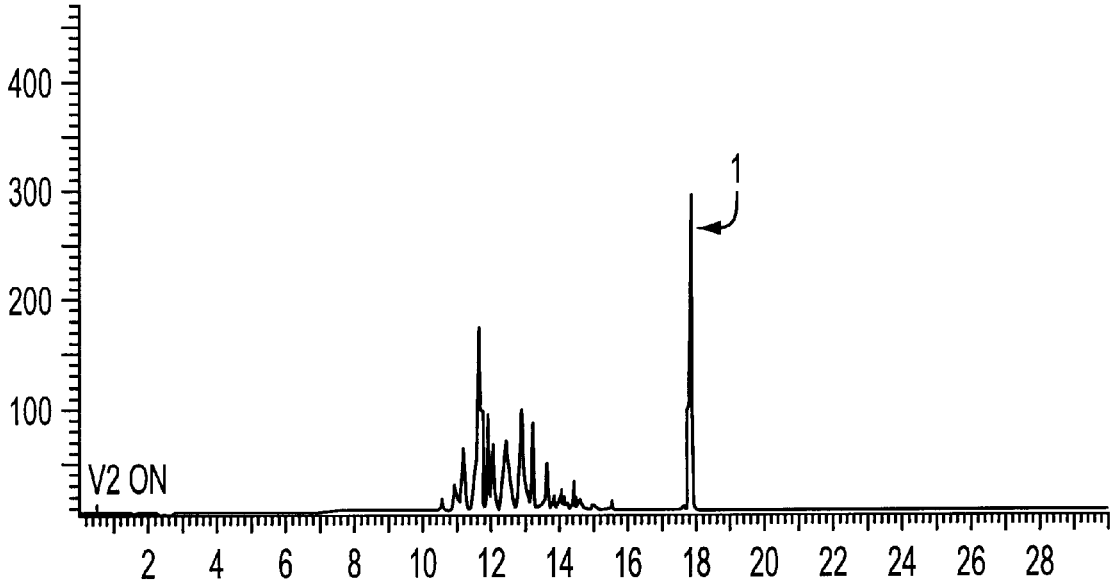
FIGS. 3*a* and 3*b* depict gas chromatographic spectra of a sample comprising a complex mixture of contaminants before and after treatment according to the invention.
Figure 3B:
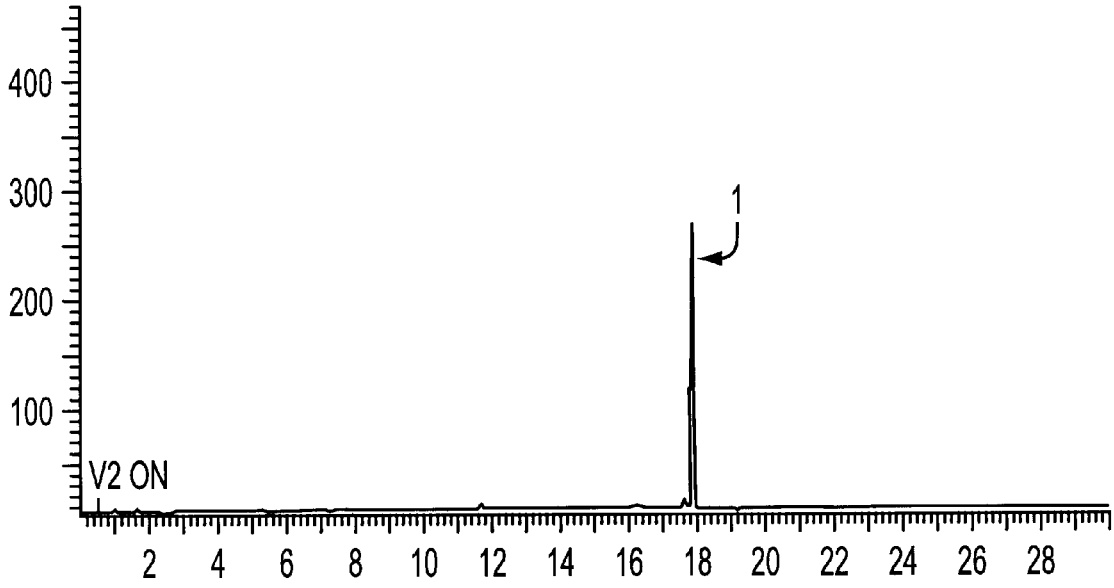
Figure 4A:
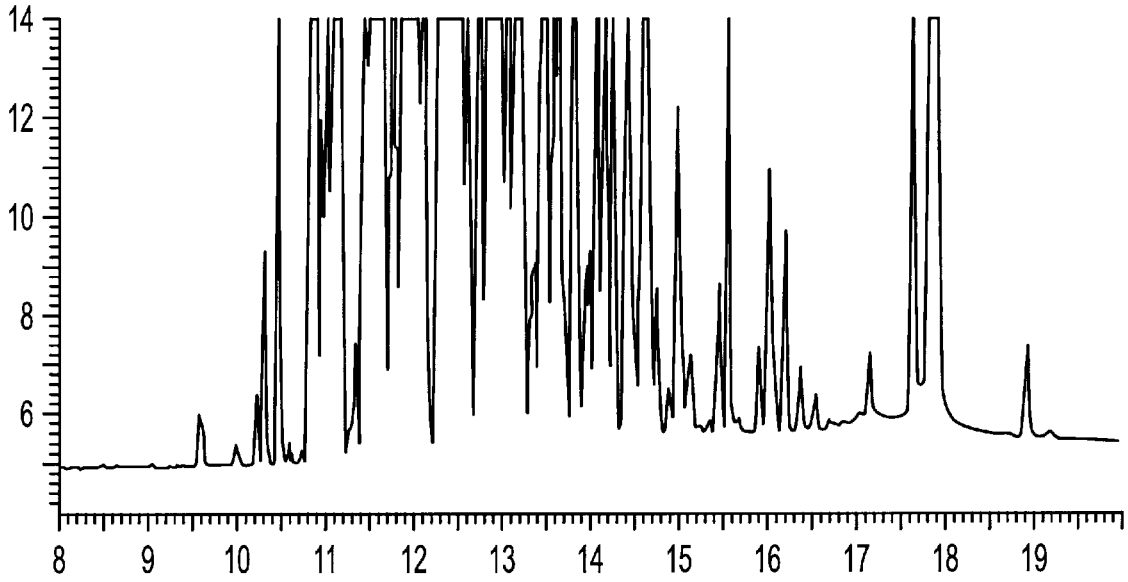
FIGS. 4*a* and 4*b* depict gas chromatographic spectra of a sample comprising a complex mixture of contaminants before and after treatment according to the invention.
Figure 4B:
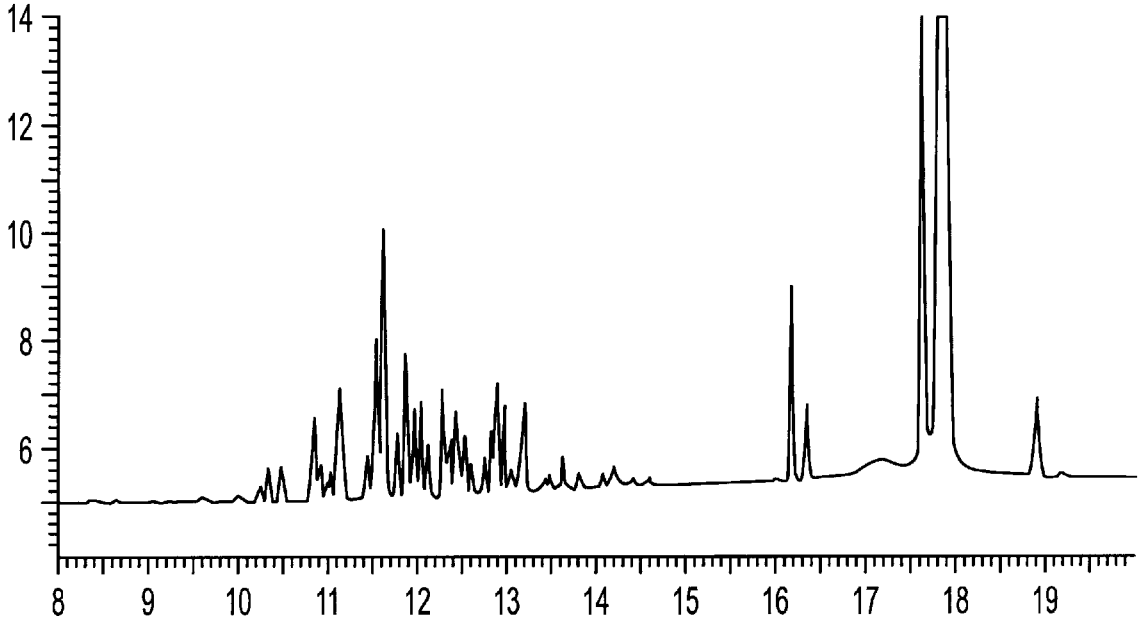
Figure 5A:
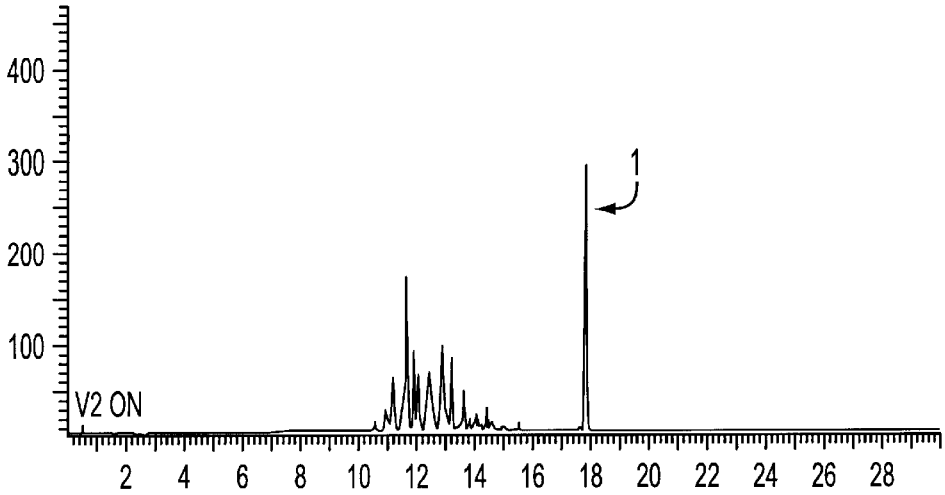
FIGS. 5*a*, 5*b* and 5*c* depict gas chromatographic spectra of a sample comprising a complex mixture of contaminants before and after treatment according to the invention.
Figure 5B:
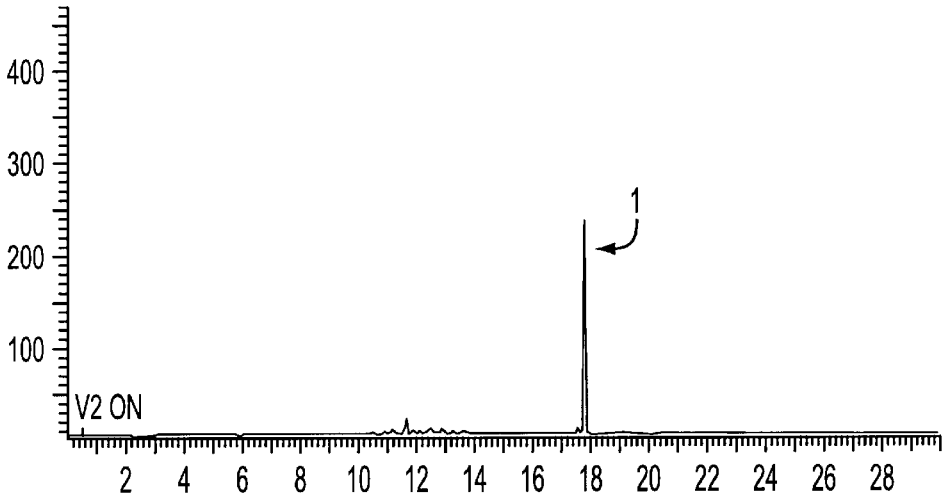
Figure 5C:
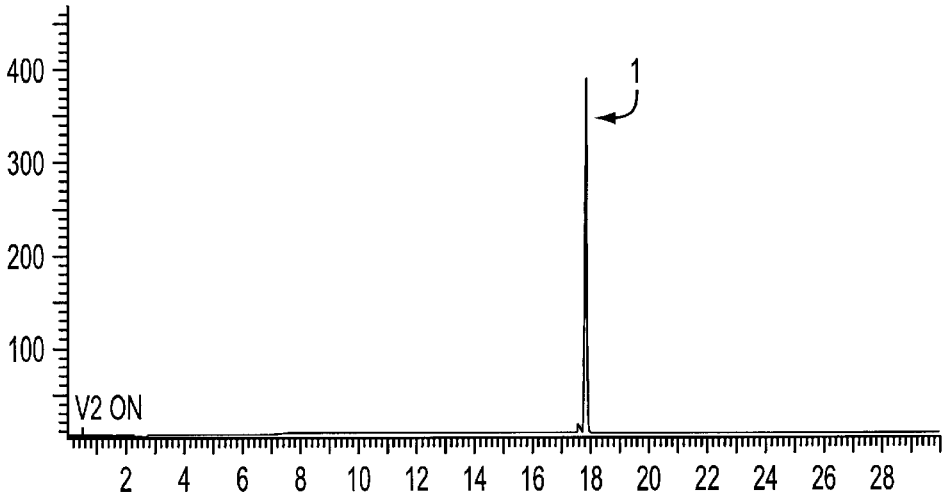
Figure 6A:
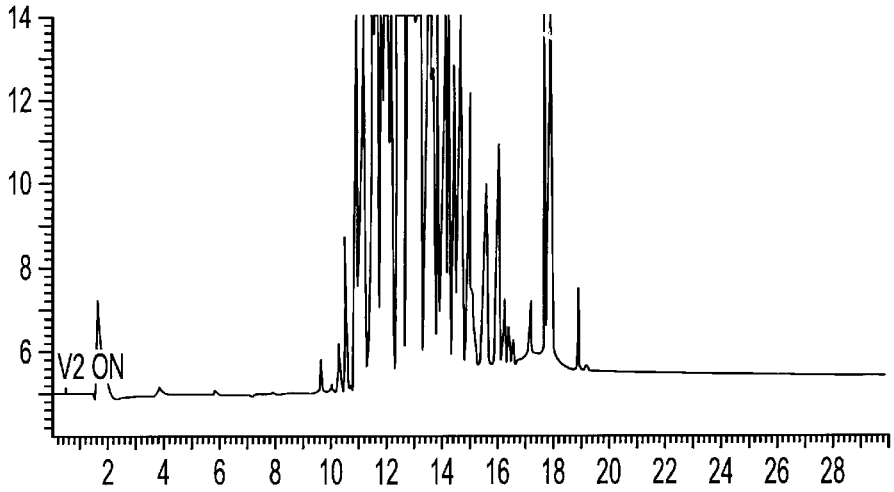
FIGS. 6*a*, 6*b* and 6*c* depict gas chromatographic spectra of a sample comprising a complex mixture of contaminants before and after treatment according to the invention.
Figure 6B:
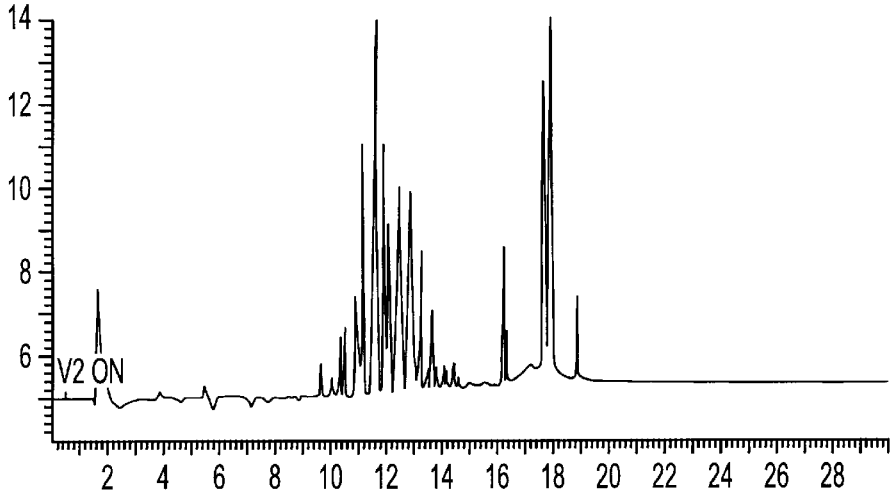
Figure 6C:
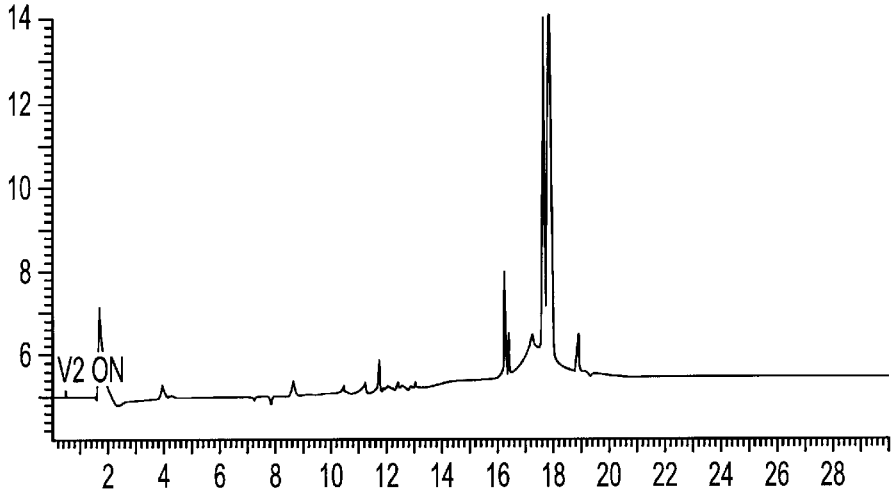

Untreated samples and samples which had been treated using the process as described in this invention were all examined gas chromatographically. The Figures show the results of some exemplary gas chromatographic analyses, in each case before and after treatment. The analyses prove that it is possible to treat even complex mixtures effectively in a short time (see FIGS. 3*a*, 3*b*, 4*a* 4*b*, 5*a*, 5*b*, 5*c*, 6*a*, 6*b* and 6*c*).

With the help of the process described in this invention, therefore, polychlorinated organic contaminants are successfully eliminated completely. This happens even when they are distributed along with an abundance of foreign substances and accompanied by other substances in complex solid or semi-solid materials, at times being very tightly bound to them adsorbtively. This process makes it possible to selectively eliminate the contaminants within minutes with complete reductive dechlorination at room temperature. Of course, contaminants which are encountered in a relatively pure form, like for example, highly concentrated PCB oils or HCH isomers which were ineffective as insecticides and which, for example, were dumped in open pits in the Bitterfeld area in former East Germany (with a degree of purity of up to 95%) in the order of several 10,000 tonnes, can be detoxified especially effectively.

In the case of transformer oils, the process as described in this invention can be used as an alternative to the existing processes (Degussa-sodium, NaPEG-, KPEG-, KPEG-PLUS), as the central idea of it is simpler and safer, and it can be carried out with simple methods and devices under mild operating conditions. This raises the possibility of recycling contaminated oils on a large scale instead of having to incinerate them. Transformer oils, in particular, a have high material value and thus a high recycling value which, however, is completely written off when they are incinerated.

The organic contaminants can be completely eliminated under conditions which are ecologically and economically favourable at room temperature and in a short time, in particular even when they occur in various mixtures.

The contaminants are broken down by simply structured reagents directly in the matrix in which they are distributed. At the same time, the materials in question, for example, can be ones which in another place accumulate in considerable quantities as left-over materials and which through this process can now be used again meaningfully.

Only a few non-toxic or less toxic and biologically degradable products are formed. This much improved compatibility with the environment is a result of the complete conversion of the reducing agent and all the organically bound halogens to non-dangerous anorganic halides. At the same time the halogen-free primary bodies of the polyhalogenated compounds are formed.

Detoxified materials, like for example, building materials or used oil can be put to meaningful uses or recycled.

In most cases there is no need for involved and cost-intensive treatment processes afterwards, like for example, the removal and elimination of surplus reagents or toxic products left over from the procedure of breaking down.

As a consequence, with this new process, the disadvantages of the processes which are currently widely used when cleaning up contaminated sites, like for example, incineration at a high temperature, are avoided.

Areas where the process as described in this invention can be applied are in particular:

Halo-organically contaminated soil and sediment;

Building materials and the trimmings and fittings on buildings which have been contaminated with PCBs (paint on walls, fine plaster, elastic stretchy filler used for filling gaps, eg. around windows, in buildings of various sorts);

Sludge which has been contaminated with PCBs;

The detoxification of the halo-organically contaminated dust particles which have been collected in filters, for example from the steel industry or refuse incineration plants;

The disposal of left-over products from the chemical industry, for example from the production of lindane (HCH isomers in the order of several 10,000 tonnes in the Bitterfeld area in former East Germany);

Red sludge containing dioxins;

The decontamination of transformer oils and motor oil contaminated with PCBs;

The decontamination of halo-organically contaminated material collected in filters, for example, adsorbents used for cleaning smoke emissions, streams of waste water, like for example activated carbon, clays, etc.

What is claimed is:

1. A process for reductive dehalogenation of at least one halo-organic substance in solid and liquid mixtures of materials, comprising:

(a) combining a material comprising at least one halo-organic substance with (i) a reducing agent selected from an elementary alkali metal, earth alkalines, aluminum or iron; and (ii) a source of hydrogen comprising at least one reagent containing relatively easily activated hydrogen to form a mixture; and, (b) milling or grinding said mixture to an extent sufficient to mechanically activate the reductive dehalogenation reaction and to substantially completely, reductively dehalogenate said at least one halo-organic substance.

2. A process according to claim 1, wherein said reducing agent comprises Na, K, Mg, Ca or Al.

3. A process according to claim 1, wherein said hydrogen source comprises an alcohol, an ether, a polyether, an amine, a hydroxide or a hydride.

4. A process according to claim 3, wherein said amine comprises at least one aliphatic amine.

5. A process according to claim 1, further comprising adding at least one of a milling supplement and a reaction accelerator to said mixture.

6. A process according to claim 5, wherein said milling supplement comprises a surface active substance for reducing or preventing deformation and/or agglomeration of solids during said step of milling or grinding.

7. A process according to claim 5, wherein said reaction accelerator comprises a reaction accelerator capable of performing at least one of the following:

(a) dissolving, at least partially, non-noble metals;

(b) promoting dissociation of non-noble metals into metal cations and metal anions and/or solvate; and (c) stabilizing the formation of solvated electrons and/or metal organic compounds.

8. A process according to claim 5, further comprising during or after said step of combining, combining said material with at least one of:

(i) a milling supplement; and (ii) a reaction accelerator.

9. A process according to claim 1, wherein said combining comprises adding said reducing agent dispersed in a non-oxidizing liquid, in a liquid source of hydrogen or in an inert solid carrier.

10. A process according to claim 9, wherein said reducing agent is dispersed in a paraffin suspension, an ether dispersion, or a polyether dispersion.

11. A process according to claim 1, further comprising, prior to said combining, treating said material with calcium oxide.

12. A process according to claim 1, wherein said milling or grinding comprises milling in a ball mill, a hammer mill, a vibratory mill or mixing in a mixer capable of transferring mechanical energy to said substance.

13. A process according to claim 1, wherein said substantially complete reductive dehalogenation takes place in a single step.

* * * * *